US006515569B2

(12) United States Patent
Lias et al.

(10) Patent No.: US 6,515,569 B2
(45) Date of Patent: Feb. 4, 2003

(54) CIRCUIT BREAKER WITH BYPASS CONDUCTOR COMMUTATING CURRENT OUT OF THE BIMETAL DURING SHORT CIRCUIT INTERRUPTION AND METHOD OF COMMUTATING CURRENT OUT OF BIMETAL

(75) Inventors: Edward Ethber Lias, Aliquippa, PA (US); Stephen Albert Mrenna, Brighton Township, PA (US); Michael Joseph Erb, Fombell, PA (US)

(73) Assignee: Eaton Corporation, Cleveland, OH (US)

( * ) Notice: Subject to any disclaimer, the term of this patent is extended or adjusted under 35 U.S.C. 154(b) by 115 days.

(21) Appl. No.: 09/739,862

(22) Filed: Dec. 18, 2000

(65) Prior Publication Data

US 2002/0075123 A1 Jun. 20, 2002

(51) Int. Cl.[7] ..... H01H 71/16; H01H 71/40; H01H 71/54; H01H 75/12

(52) U.S. Cl. ..... 337/37; 337/36; 337/59; 337/70; 337/111; 335/35; 361/93.8; 361/99; 361/102; 361/105

(58) Field of Search ..... 337/35–37, 61, 337/201, 141, 59, 66, 70, 105, 106, 99, 111, 373, 378, 379; 335/23–25, 31, 35, 201; 361/42, 46–50, 93, 99, 102–105, 170

(56) References Cited

U.S. PATENT DOCUMENTS

| | | | | |
|---|---|---|---|---|
| 3,605,052 A | * | 9/1971 | Dimond et al. | 335/166 |
| 3,617,970 A | * | 11/1971 | Hanafusa et al. | 335/16 |
| 3,708,771 A | * | 1/1973 | Schreckenberg et al. | 335/176 |
| 3,849,747 A | | 11/1974 | Mrenna et al. | |
| 3,953,812 A | * | 4/1976 | Heft et al. | 335/23 |
| 4,080,582 A | * | 3/1978 | Link | 335/37 |
| 4,675,635 A | * | 6/1987 | DiMarco et al. | 335/35 |
| 4,675,640 A | * | 6/1987 | DiMarco et al. | 335/43 |
| 4,679,016 A | | 7/1987 | Ciarcia et al. | |
| 4,884,049 A | * | 11/1989 | Oyama et al. | 337/36 |
| 4,933,653 A | | 6/1990 | Mrenna et al. | |
| 5,008,645 A | | 4/1991 | Mrenna | |
| 5,432,491 A | * | 7/1995 | Peter et al. | 335/23 |

FOREIGN PATENT DOCUMENTS

| | | | | |
|---|---|---|---|---|
| GB | 2228829 A | * | 5/1990 | H01H/71/16 |

* cited by examiner

*Primary Examiner*—Anatoly Vortman
(74) *Attorney, Agent, or Firm*—Martin J. Moran

(57) ABSTRACT

The high transient current sustained by arcing during opening of the main contacts of a miniature circuit breaker is commutated out of the bimetal by deflection of the bimetal in response to the overcurrent to close secondary contacts on the free end of the bimetal and on a low resistance by-pass conductor shunting the bimetal. The by-pass conductor can be extended toward the movable contact arm carrying the movable main contact to commutate some of the overcurrent into the by-pass conductor earlier in the opening sequence to reduce the energy input to the bimetal and reduce the force closing the secondary contacts.

5 Claims, 4 Drawing Sheets

CIRCUIT BREAKER WITH BYPASS CONDUCTOR COMMUTATING CURRENT OUT OF THE BIMETAL DURING SHORT CIRCUIT INTERRUPTION AND METHOD OF COMMUTATING CURRENT OUT OF BIMETAL

BACKGROUND OF THE INVENTION

1. Field of the Invention

This invention relates to circuit breakers and their operation and particularly to circuit breakers having a trip mechanism with a bimetal and to an arrangement and method for commutating current out of the bimetal following a trip.

2. Background Information

A type of circuit breaker commonly used in residential and light commercial applications is known as a miniature circuit breaker. Such circuit breakers have a fixed contact and moveable contact carried by a pivoted moveable contact arm of a spring powered operating mechanism. The operating mechanism includes a handle through which the moveable contact arm can be pivoted to manually open and close the contacts. The circuit breaker further includes a thermal-magnetic trip device which responds to overcurrent conditions to automatically actuate the operating mechanism to open the main contacts. A delayed or thermal trip is provided by a bimetal which is held fixed at one end, leaving the other end free to deflect in response to the heat generated by the current passing through the bimetal which is connected in series with the main contacts. A persistent current in excess of a predetermined rated current causes the bimetal to bend sufficiently to unlatch or trip the spring powered operating mechanism, which in turn opens the main contacts. A magnetic or instantaneous trip is provided by a magnetic armature which is attracted by the magnetic field generated by a very high overcurrent such as that associated with a short circuit to also unlatch the operating mechanism and open the main contacts.

While the operating mechanism rapidly opens the main contacts in response to a trip, the current is not immediately interrupted because an arc is struck across the opening main contacts. Thus, even though the main contacts physically separate, current continues to flow through the circuit breaker including the bimetal for up to eight to ten msec before the arc is extinguished. Although such a miniature circuit breaker may have a rated current (maximum continuous current) of, for instance 10 amps, modern electrical distribution systems are capable of delivering many thousands of amperes in response to a short circuit. Even though the magnetic armature responds instantaneously to trip the main contacts open, the continuing high overcurrent supported by the arc rapidly heats the bimetal. Existing miniature circuit breakers can withstand such high currents when operated at a 120 and even 240 volts. However, there are attempts now to extend the application of these miniature circuit breakers to 277 volt installations. It has been found that when interrupting very high currents at these voltages the bimetal deflects so rapidly that it impacts its stop with such force that the bimetal takes a set and loses its calibration. This damage can occur on a single interruption.

In order to reduce the duration of the very high current associated when a short circuit flows through the bimetal and to preclude damage to the bimetal of a miniature circuit breaker, our co-pending application Ser. No. 09/689,497, filed on Oct. 12, 2000, places a bypass conductor in shunt with the bimetal as the moveable contact arm carrying the moveable contact moves to the open position. This bypass conductor is connected at one end to the load terminal to which the bimetal is also connected. The second end of the bypass conductor is positioned so that as the contact arm moves to the open position the arc extends to the free end of the bypass conductor, thereby commutating current to the bypass conductor. Essentially then, the bypass conductor forms a low resistance path in parallel with the current path through the bimetal.

While this arrangement greatly reduces the current flowing through the bimetal until the main arc is extinguished and all current flow ceases, the arc introduces resistance into the parallel current paths so that appreciable current can still flow through the bimetal.

There is a need therefore for an improved circuit breaker with a bimetal in the trip mechanism which can withstand short circuit currents repeatedly without damage.

There is a further need for such an improved circuit breaker and method which can successfully commutate virtually all of the current out of the bimetal during interruption of a very large current such as those associated with a short circuit.

SUMMARY OF THE INVENTION

These needs and others are satisfied by the invention which is directed to a circuit breaker and a method in which virtually all of the current is commutated out of the bimetal during interruption of very large overcurrents such as those associated with a short circuit. More particularly, the invention is directed to a circuit breaker in which the bimetal of the trip mechanism electrically contacts a bypass conductor shunting the bimetal as the bimetal deflects in response to the very large overcurrent.

Specifically, the invention is directed to a circuit breaker comprising a pair of main contacts including a fixed contact and a moveable contact. The circuit breaker includes a load terminal and a line terminal to which the fixed contact is connected. The circuit breaker further includes an operating mechanism for opening the main contacts when tripped, and a trip mechanism which includes a bimetal having a fixed end electrically connected to the load terminal and a free end electrically connected to the moveable contact. The bimetal is deflected in response to the very large overcurrent through the main contacts to trip the operating mechanism and thereby open the separable contacts. A bimetal bypass comprising a bypass conductor is connected to the load terminal and is positioned to commutate current passing through the bimetal to the bypass conductor through deflection of the bimetal in response to an overcurrent sufficient to trip the operating mechanism. The free end of the bimetal and the bypass conductor can have secondary contacts which engage to electrically connect the bimetal to the bypass conductor to provide better wear characteristics. Preferably, the bypass conductor is a flat conductive strap with an electrical resistance which is substantially less than that of the bimetal.

The operating mechanism includes a moveable contact arm to which the moveable contact is secured, and a flexible shunt electrically connecting the moveable contact arm to the free end of the bimetal. The bypass conductor can be extended toward the moveable contact arm and positioned to commutate at least some of the current from the moveable contact arm to the bypass conductor. The arrangement is such that current is commutated from the moveable contact arm to the bypass conductor and then the bimetal electrically contacts the bypass conductor to commutate any remaining current through the bimetal to the shunt provided by the bypass conductor. Typically, the trip mechanism also includes a magnetic armature which trips the operating mechanism in response to the very large overcurrent, which brings the moveable contact arm in proximity with the extended bypass conductor and thereby initially commutate current into the bypass conductor.

The invention also embraces the method of commutating current out of the bimetal connected at a free end to the main contacts and at a fixed end to the load terminal in a circuit breaker by connecting a bypass conductor to the load terminal and positioning the bypass conductor to be electrically connected to the free end of the bimetal as the bimetal deflects in response to a very high overcurrent. The method further includes extending the bypass conductor to be adjacent the moveable contact of the main contacts as the main contacts open to commutate at least part of the current from the moveable contact arm to the bypass conductor. The bypass conductor is arranged such that the current is commutated to the bypass conductor from the moveable contact arm before the free end of the bimetal is electrically connected to the bypass conductor.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
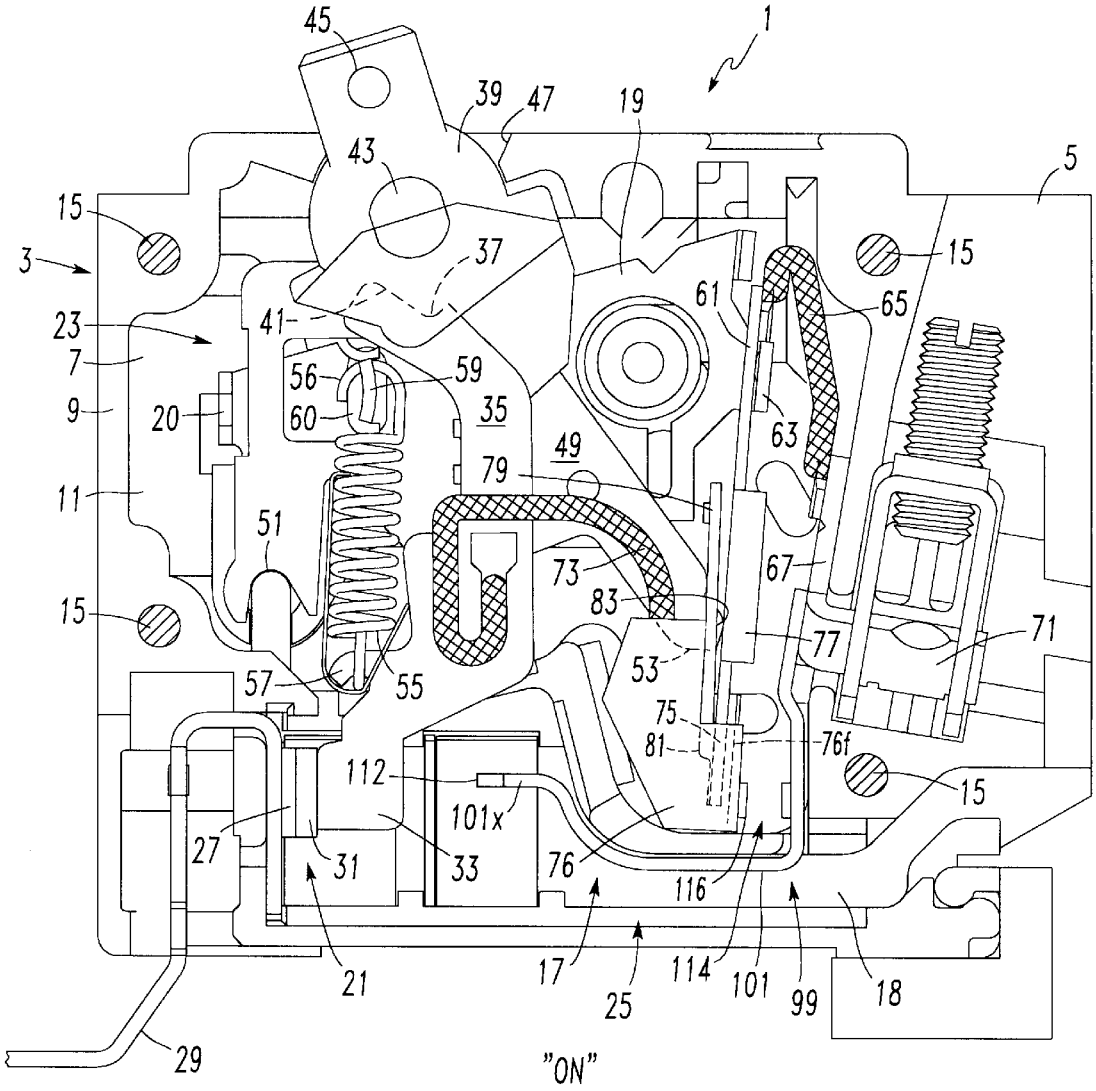
FIG. 1 is a side elevation view of a circuit breaker incorporating the invention with the cover removed and shown in the ON or CLOSED position.

Referring to the drawings, the circuit breaker 1 of the invention comprises an electrically insulating housing 3 having a molded insulating base 5 having a planar wall 7 and edge walls 9 forming a cavity 11. The housing 3 further includes a molded insulating cover (not shown) which is secured to the base 5 by four rivets 15. A circuit breaker assembly, indicated generally at 17 in FIG. 1, is supported in the cavity 11 of the housing. The circuit breaker assembly 17 includes a support plate 19 having a stop 20, a set of main contacts 21, a latchable operating mechanism 23 and trip assembly 25.

The set of main contacts 21 includes a fixed or stationary contact 27 secured to a line terminal 29, and a movable contact 31 secured to the edge of the free end 33 of a flat metallic, generally C-shaped contact arm 35 which forms part of the latchable operating mechanism 23. The contact arm 35 is provided at the upper end with a depression 37. A molded insulating operating member 39 has a molded part 41 which engages the depression 37 in the contact arm 35 to provide a driving connection between the operating member 39 and the contact arm 35. The operating member 39 is molded with a pair of pins 43 extending outwardly on opposite sides (only one shown) which fit into bearing openings (not shown) in the base 5 and the cover of the housing 3 to support the operating member 39 for pivoted movement. The operating member 39 includes a handle part 45 which extends through an opening 47 on top of the housing 3 to enable manual operation of the circuit breaker 1. The operating member 39 also includes downwardly extending portion 48 (see FIG. 2) for engaging the latchable operating mechanism 23 so as to provide for resetting the circuit breaker 1 following tripping.

The latchable operating mechanism 23 also includes a cradle 49 supported at one end for pivoted movement on a molded post part 51 of the insulating housing base 5. The other end of the cradle 49 has a latch ledge 53 which is latched by the trip assembly 25, which will be described in more detail herein. An over center tension spring 55 is connected, under tension, at one end to a projection 57 near the lower end of the contact arm 35, and at the upper end thereof to a bent over projection 59 on the cradle 49.

The trip assembly 25 comprises an elongated bimetal member 61 secured, in proximity to its upper end, to a bent over tab 63 on the support plate 19. A flexible conductor 65 is secured at one end to the upper end of the bimetal member 61 and at the other end to a conductor 67 that extends through an opening in the housing 3 and is part of a solderless terminal connector 71 that is externally accessible and supported in the housing 3 in a conventional manner. Another flexible conductor or shunt 73 is secured at one end to the free, lower end 75 of the bimetal member 61 through a bracket 76 described below and at the other end thereof to the contact arm 35 to electrically connect the contact arm 35 with the bimetal member 61.

The trip assembly 25 includes a thermal trip capability which responds to persistent low level overcurrents and a magnetic trip capability which responds substantially instantaneously to higher overload currents. The trip assembly 25 includes the bimetal member 61, a magnetic yoke 77 and a magnetic armature 79. The magnetic yoke 77 is a generally U-shaped member secured to the bimetal member 61 at the bight portion of the magnetic yoke 77 with the legs thereof facing the armature 79. The magnetic armature 79 is secured to a supporting spring 81 that is in turn secured at its lower end near the free end 75 of the cantilevered bimetal member 61. Thus, the armature 79 is supported on the bimetal member 61 by the spring 81. The armature 79 has a window opening 83 through which the one end of the cradle 49 extends with the latch ledge 53 on the cradle engaging the edge of the window 83 to latch the latchable operating mechanism 23 in the latched position, as shown in FIG. 1.

Figure 3:
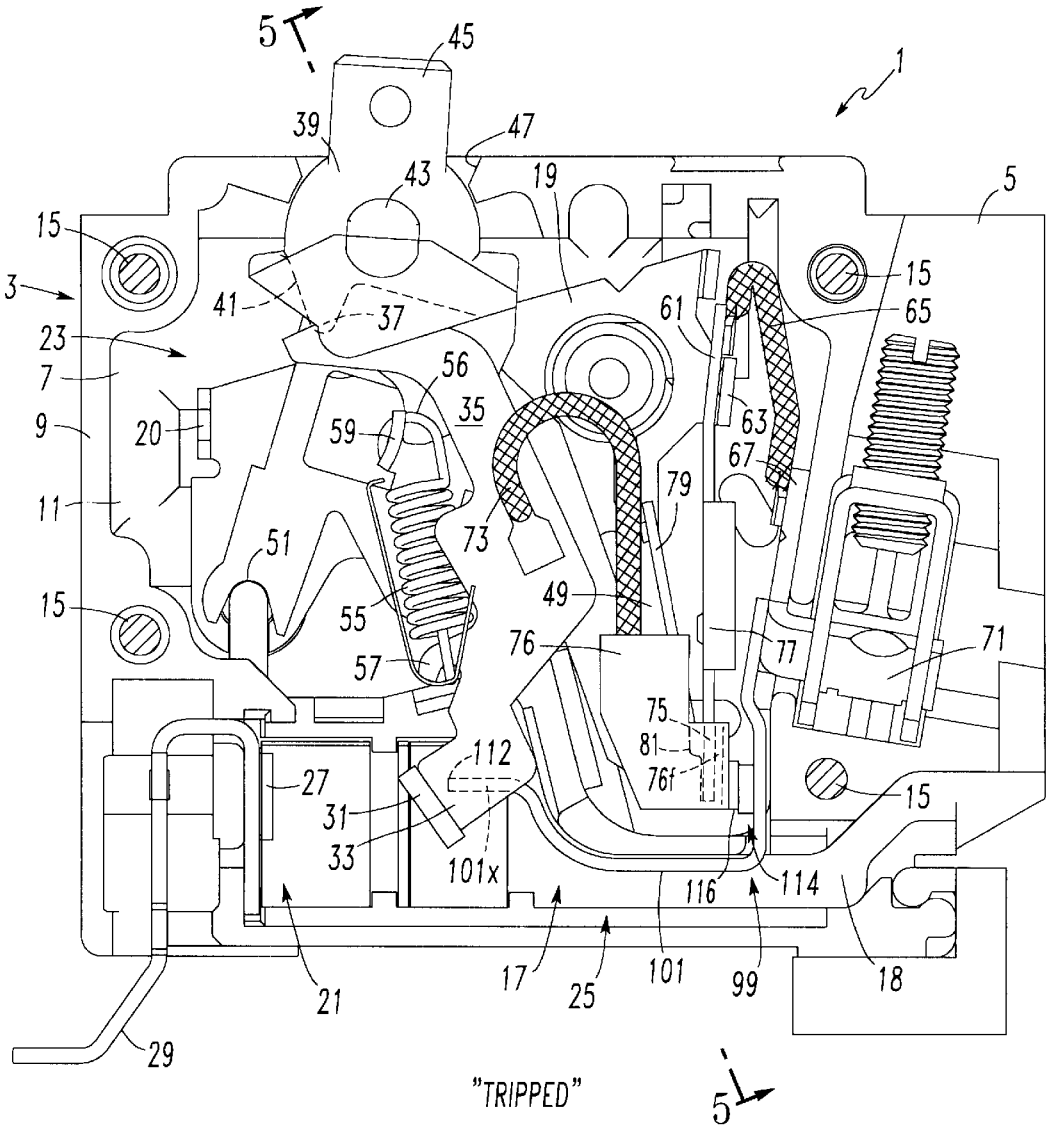
FIG. 3 is a view similar to FIG. 1 showing the circuit breaker in the TRIPPED position.

With the circuit breaker in the ON position, as shown more particularly in FIG. 1, a persistent overload current of a predetermined value causes the bimetal member 61 to become heated and deflect to the right to effect a time delayed thermal tripping operation. The armature 79, which is supported on the bimetal member 61 by means of the leaf spring 81, is carried to the right with the bimetal member to release the cradle 49. When the cradle 49 is released, the spring 55 rotates the cradle clockwise on the post 51 until this motion is arrested by the engagement of the cradle with a molded part 85 of the housing base 5. During this movement, the line of action of the spring 55 moves to the right of the point at which the contact arm 35 is pivoted on the operating member 39 to rotate the contact arm counterclockwise to snap the set of main contacts 21 open. FIG. 3 shows this tripped condition of the circuit breaker.

The circuit breaker 1 is magnetically tripped automatically and instantaneously in response to overload currents above a second predetermined value higher than the predetermined value for the thermal trip. Flow of overload current above this higher predetermined value through the bimetal member 61 induces magnetic flux around the bimetal. This flux is concentrated by the magnetic yoke 77 toward the armature 79. Overload current above the second predetermined value generates a magnetic force of such strength that the armature 79 is attracted toward the magnetic yoke 77 resulting in the flexing of the spring 81 permitting the armature 79 to move to the right to release the cradle 49 and trip the circuit breaker open in the same manner as described with regard to thermal tripping operation.

Figure 2:
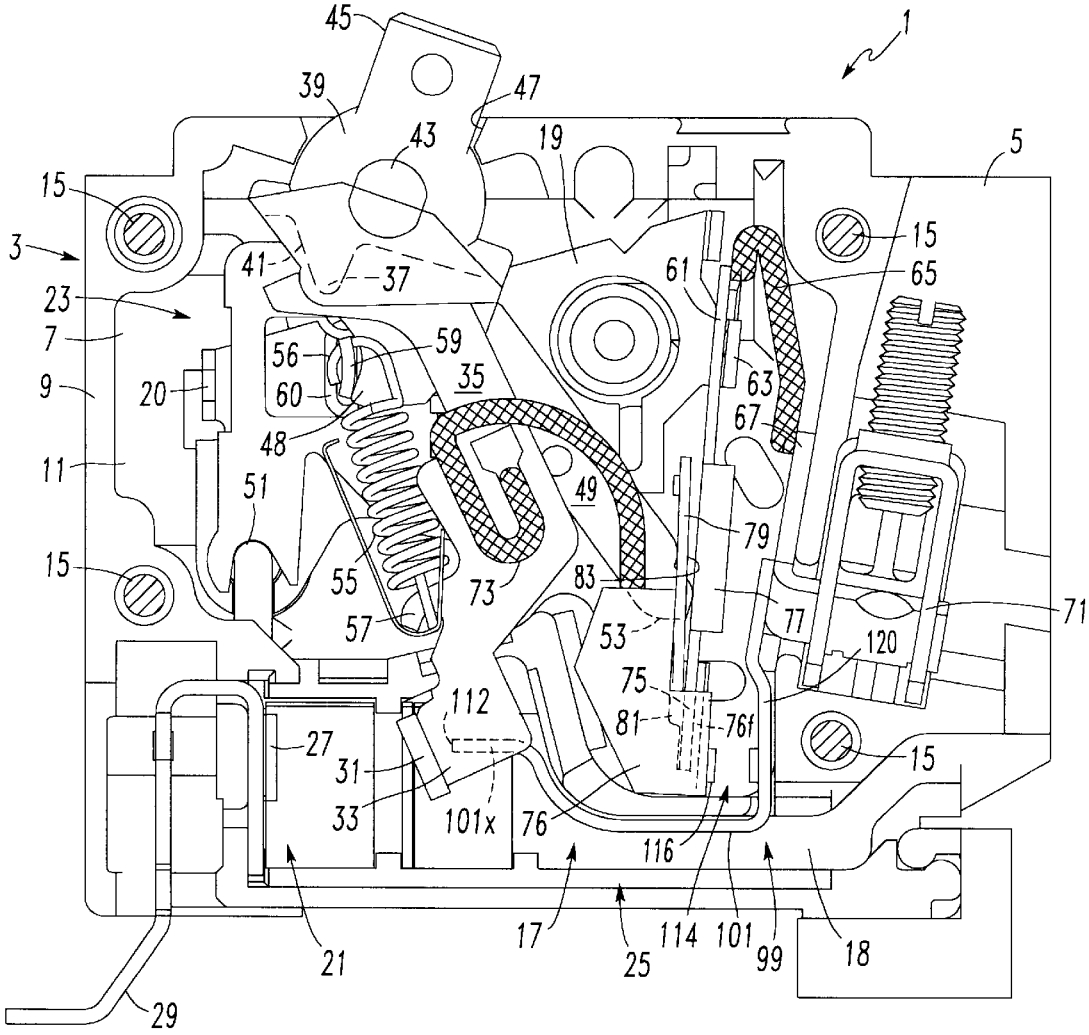
FIG. 2 is a view similar to FIG. 1 showing the circuit breaker in the OFF or OPEN position.

Following either a thermal or a magnetic trip the circuit breaker is reset by moving the handle 45 to the OFF position and then slightly beyond so that the extension 48 on the operating member engages the bent over projection 59 on the cradle 49 and rotates the cradle to relatch the latching surface 53 in the window 83 in the armature 79. The resulting OFF position is shown in FIG. 2. The circuit breaker 1 may be turned on from this position by rotating the handle counterclockwise, which through the molded part 41 moves the upper end of the contact arm to the right in FIG. 2. When the contact point 37 on the upper end of the contact arm 35 crosses the line of force of the spring 55, the contacts snap closed to the ON position shown in FIG. 1. The circuit breaker 1 is returned to the OFF position manually by moving the handle clockwise as shown in FIG. 1.

Figure 4:
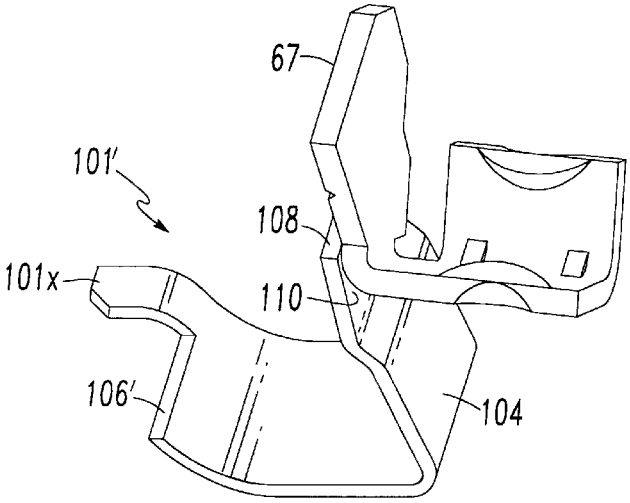
FIG. 4 is an isometric view of a by-pass conductor which forms part of the invention.
Figure 5:
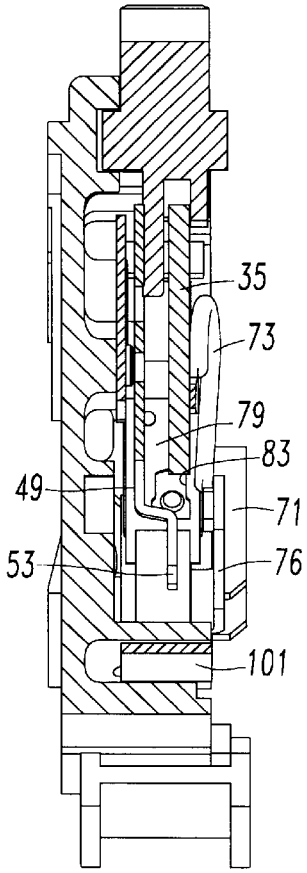
FIG. 5 is a section through the circuit breaker taken along the line 5—5 in FIG. 3.

Referring now to FIGS. 2 through 4, a bimetal by-pass 99 includes a bypass conductor 101 shown supported within the housing 3 of the circuit breaker 1. The bypass conductor 101 can include an elongated flat strap having a middle portion that includes a substantially right-angled body portion 104. The bypass conductor 101 has a first end 106 adapted to be positioned adjacent to or in contact with a contact arm 35 of the circuit breaker 1 in an open circuit position or TRIPPED position of the circuit breaker 1. This permits the bypass conductor 101 to receive current, especially high transient current, flowing through the circuit breaker 1 during an event such as a circuit overload. A second end 108 of the bypass conductor 101 is electrically connected to the load terminal 71 of the circuit breaker 1 through the conductor 67 to provide a path for current between the first end 106 and the second end 108 through the bypass conductor 101.

The bypass conductor 101 is preferably composed of a metal such as copper or another suitable metal alloy or electrically conductive composite. The material from which the bypass conductor 101 is composed provides a lower resistance path relative to the conventional path for electrical current passing through the circuit breaker. In the TRIPPED position shown in FIG. 3, the contact arm 35 can come into substantial intimate contact with an end of the bypass conductor 101 or can be separated, preferably by a bypass gap distance $d_1$ of about 0 mm to 0.8 mm between the end of the bypass conductor 101 and the contact arm 35. By providing a relatively lower-resistance path for current in parallel with the conventional path, the bypass conductor 101 thereby enables improved interruption of a relatively high transient electrical arc. The bypass conductor 101 therefore helps to direct current away from the thermal trip mechanism and other components of the circuit breaker 1.

At least a portion of the bypass conductor 101 is positioned in communication with a gas vent 18 of the circuit breaker 1. This positioning of the bypass conductor 101 in the gas vent 18 promotes commutation of a high transient current to the bypass conductor 101.

In operation, when the movable contact portion 31 of the contact arm 35 moves to a substantially fall open circuit position, a situation favorable to arc formation is provided. Opening of the main contacts 21 in the presence of a high transient current produces an arc that can be commutated to the bypass conductor 101. This commutation is due primarily to the positioning of the first end 106 of the bypass conductor 101 adjacent to or in substantial contact with the flat end 33 of the contact arm 35 during movement of the contact arm 35 to open and close the main contacts 21.

The bypass conductor 101 has an extension 101*x* on the first end 106 which extends upward and then forward toward the left as viewed in FIGS. 1, 2 and 4 to overlap the flat end 33 of the contact arm 35 with the contact arm in the open or tripped positions. The tip 112 of the extension 101*x* extends almost to the moveable contact 31 which is secured on the end of the flat contact arm. In this arrangement, there is an extended area of overlap between the bypass conductor, and the contact arm and moveable contact for supporting the secondary arc through which current is commutated from the contact arm 35 to the bypass conductor. This commutates the current to the bypass conductor soon after the contacts 27 and 31 begin to open thereby reducing the energy input to the bimetal and also helps in interrupting the main arc between the fixed and moveable contacts 27 and 31.

Figure 6:
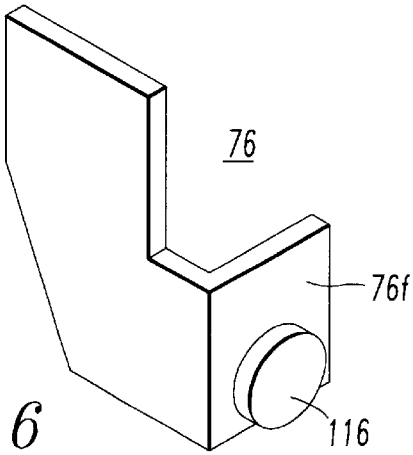
FIG. 6 is an isometric view of a bracket mounting a secondary contact on the bimetal in accordance with the invention.

In order to more completely commutate high transient out of the bimetal, the bypass conductor 101 is positioned to be electrically connected to the free end 75 of the bimetal 61 as the bimetal deflects in response to a very high overcurrent. In order to provide an electrical connection with low resistance and good wear, the bimetal by-pass 99 further includes a pair of secondary contacts 114 including contact 116 on the free end 75 of the bimetal 61 and contact 118 on the bypass conductor 101. Referring to FIG. 6, the secondary contact 116 is secured on a flange 76*f* of the shunt bracket 76 which, as can be seen in FIG. 3, also connects the shunt 73 to the free end of the bimetal 61. This shunt bracket 76 is made of a material with low electrical resistance such as copper, and provides a convenient arrangement for securing both the shunt 73 and the secondary contact 16 to the limited area available on the free end 75 of bimetal 61.

While the bypass conductor could be shortened so that only the vertical section adjacent the second end 108 and carrying the secondary contact 118 is provided, it is preferred that the full bypass conductor as described above be used. Preferably, the bypass conductor is arranged so that as the magnetic trip feature responds to the very high transient current and unlatches the operating mechanism 23 to open the main contacts 21, some of the current is commutated from the contact arm 35 to the end 106 of the bypass conductor 101. This diversion of some of the current out of the bimetal slows the deflection of the bimetal, however it continues to deflect until the secondary contacts 114 close. As the secondary contacts provide a much lower resistance path to the load terminal 71 than either the bimetal or the arc between the contact arm and the extension 101*x* on the end 106 of the bypass conductor, virtually all of the current is commutated out of the bimetal 61. This eliminates the situation that was observed in some cases of very high overcurrents where even with the bypass conductor commutating some of the current from the contact arm to the load terminal, the bimetal would be driven against a stop either formed by the conductor or a molded part of the casing with such force that the bimetal was permanently deformed, thereby destroying the calibration.

It can therefore be appreciated that the bypass conductor apparatus of the present invention provides improved protection of sensitive bi-metallic components within a circuit breaker. The bypass conductor as disclosed redirects potentially damaging high transient currents along an alternate, relatively lower resistance path through the circuit breaker. The bypass conductor thereby reduces the likelihood of damage to the circuit breaker that can be caused by excessive electrical current. The bypass conductor can also enhance the useful life and proper functioning of the circuit breaker after a transient event has occurred.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker comprising:

a pair of main contacts including a fixed contact and a moveable contact;

a line terminal connected to the fixed contact and a load terminal;

an operating mechanism for opening the main contacts when tripped;

a trip assembly comprising a bimetal having a fixed end electrically connected to the load terminal and a free end electrically connected to the moveable contact, the bimetal being deflected in response to an overcurrent through the main contacts to trip the operating mechanism to open the main contacts;

a bimetal bypass comprising a bypass conductor connected to the load terminal and positioned to commutate current passing through the bimetal to the bypass conductor through deflection of the bimetal in response to an overcurrent sufficient to trip the operating mechanism;

wherein the operating mechanism includes a moveable contact arm carrying the moveable contact moveable to an open position in which the main contacts are separated, and a flexible shunt electrically connecting the contact arm to the free end of the bimetal, and wherein the bypass conductor extends toward the moveable contact arm to commutate at least some current from the moveable contact arm to the bypass conductor.

2. The circuit breaker of claim 1 wherein the trip mechanism further includes a magnetic armature responsive to short circuit currents to trip the operating mechanism and move the moveable contact arm toward the bypass conductor to commutate at least some current into the bypass conductor before the free end of the bimetal is electrically connected to the bypass conductor.

3. The circuit breaker of claim 2 wherein the trip mechanism further includes secondary contacts on the free end of the bimetal and the bypass conductor which engage to commutate any remaining current through the bimetal to the bypass conductor.

4. A method of commutating current out of a bimetal electrically connected at a free end to the main contacts and at a fixed end to the load terminal in a miniature circuit breaker, comprising the steps of:

connecting a bypass conductor to the load terminal;

positioning the bypass conductor to be electrically connected to the free end of the bimetal deflected in response to a short circuit current; and wherein the main contacts include a moveable contact mounted on a moveable contact arm which pivots when the circuit breaker is tripped, the step of positioning the bypass conductor further including extending the bypass conductor to be adjacent the moveable contact as the moveable contact arm opens the main contacts.

5. The method of claim 4 wherein positioning the bypass conductor comprises arranging the bypass conductor such that current is commutated to the bypass conductor from the moveable contact before the free end of the bimetal is electrically connected to the bypass conductor.

* * * * *